US008998052B1

(12) United States Patent
Mitchell

(10) Patent No.: US 8,998,052 B1
(45) Date of Patent: Apr. 7, 2015

(54) SKATEBOARD CARRIER STRAP WITH REFLECTIVE STRIPE

(76) Inventor: James Dunstan Mitchell, New York, NY (US)

( * ) Notice: Subject to any disclaimer, the term of this patent is extended or adjusted under 35 U.S.C. 154(b) by 310 days.

(21) Appl. No.: 12/803,172

(22) Filed: Jun. 20, 2010

Related U.S. Application Data

(60) Provisional application No. 61/269,056, filed on Jun. 19, 2009.

(51) Int. Cl.
*A45C 1/04* (2006.01)
*A45F 3/14* (2006.01)
*A45F 4/00* (2006.01)

(52) U.S. Cl.
CPC ..... *A45F 3/14* (2013.01)

(58) Field of Classification Search
CPC ..... A45F 3/005; A45F 3/00
USPC ..... 224/660, 600, 607, 258, 250, 257, 664, 224/917, 922, 150, 578, 579
See application file for complete search history.

(56) References Cited

U.S. PATENT DOCUMENTS 3,499,416 A * 3/1970 Thorsheim ..... 116/200
4,751,923 A * 6/1988 Marino ..... 602/4
4,819,845 A * 4/1989 Byrd ..... 224/603
4,863,083 A * 9/1989 Chen ..... 224/663
5,016,794 A 5/1991 Beagle, Jr.
5,083,692 A * 1/1992 Treese ..... 224/615
5,092,506 A 3/1992 Bolduc
5,318,209 A * 6/1994 Rader et al. ..... 224/250
5,335,835 A * 8/1994 Hogan ..... 224/257
5,450,991 A * 9/1995 Neading ..... 224/578
5,492,254 A 2/1996 Challoner
5,647,522 A * 7/1997 Routh ..... 224/651
(Continued)

*Primary Examiner* — Justin Larson
*Assistant Examiner* — Lester L Vanterpool
(74) *Attorney, Agent, or Firm* — James D Mitchell

(57) ABSTRACT

This is a skateboard carrier strap that is designed in a manner to that of a waist belt. This is a skateboard carrier strap that is worn in said manner when not appropriating a skateboard. It is a carrier body strap in its separated state [FIG. 2] having a lower carrier body strap 10*a* member and an upper carrier body strap member 10*b*. Additionally there are loop straps 12 members located and attached at each end of upper member carrier body strap and lower member carrier body strap. Alternatively there are VELCRO (hook&loop) fastener open loop straps with high friction adhesive inlay, making this skateboard carrier suitable to appropriate multiple dimensions of long boards, skate boards and deck boards.

Figure 1:
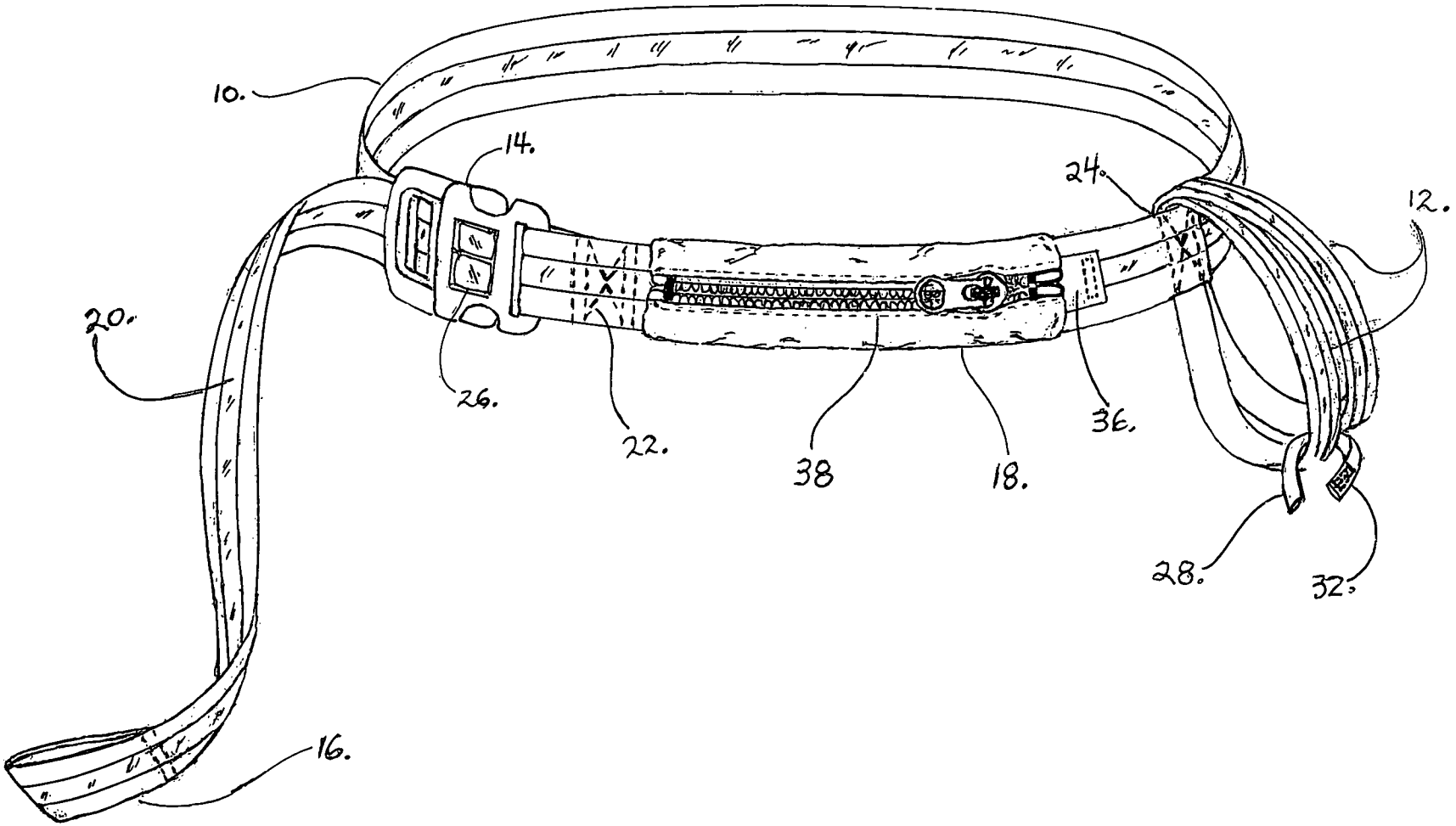

The essence of this present art; it is a skateboard carrier strap designed and styled to be worn like a fashionable belt, when not being used to appropriate a skateboard. It is a no bulk, unobtrusive skateboard carrier suitable and desirable to those skilled in the present art. Its design makes it very accommodating to the skateboarder's persons, also appreciated by one skilled in the present art. It has a illuminating stripe that contours to the carrier's complete and entire length on both sides of the skateboard carrier strap webbing.

Its illuminating stripe suggestively implies usage as a safety strap, in both its reflective feature and or, (see Specifications) its extended strap form design. It is a carrier for today's times and those in it, who are avid purchaser and appreciators of skateboard paraphernalia that is, the board pushers of today. The transparency of this present invention's superiority is that it has eluded the unattractiveness, balky and cumbersomeness, that plagues the outdated and out of touch prior art, and the other skateboard carriers.

9 Claims, 4 Drawing Sheets

(56) References Cited

U.S. PATENT DOCUMENTS

| | | | | | |
|---|---|---|---|---|---|
| 5,690,261 | A * | 11/1997 | Moore | 224/578 |
| 5,718,363 | A * | 2/1998 | Graves | 224/250 |
| 5,746,361 | A * | 5/1998 | Johnson | 224/258 |
| 5,855,306 | A * | 1/1999 | Masak | 224/250 |
| 6,145,721 | A * | 11/2000 | Gately | 224/680 |
| 6,264,081 | B1 * | 7/2001 | Wojciak et al. | 224/251 |
| 6,371,346 | B1 * | 4/2002 | Sharma | 224/578 |
| 6,491,196 | B1 * | 12/2002 | Coler | 224/602 |
| 6,536,639 | B1 * | 3/2003 | Frank | 224/257 |
| 6,637,077 | B2 * | 10/2003 | Doty | 24/302 |
| 6,672,495 | B2 * | 1/2004 | Sagan | 224/579 |
| 2006/0273128 | A1 * | 12/2006 | Balakier | 224/578 |
| 2008/0296325 | A1 * | 12/2008 | Tepper | 224/148.6 |

* cited by examiner

SKATEBOARD CARRIER STRAP WITH REFLECTIVE STRIPE

CROSS REFERENCE TO RELATED APPLICATION

U.S. PTO No. 61/269,056

FEDERALLY SPONSORED RESEARCH

Not Applicable

FIELD OF INVENTION

This invention relates to a Skateboard Carrier Strap with a Reflective Stripe. Specifically a new and improved, Waist Belt Design Style Skateboard Carrier Strap, with Reflective Stripe. A Personal Items Pouch (not claimed).

BACKGROUND OF INVENTION

Skateboarding has been around since the mid-1960s, it has become increasingly popular within the last 20 years. Skate boarding's mainstream popularity has been within the last 10 years and commands its own Olympic type of competitive games, (called X Games) along with snowboarding. As with most competitive sports there is preparation and equipment to carry and, this is no different for the skateboarders who head to the skate parks or ride the streets of today. Creators and inventors of [prior art] have tried to answer the call for an efficient unobtrusive lightweight quick and easy skateboard carrier, for today's modern day skateboarders but have not succeeded.

There was the common backpack type of carrier with additional horizontal straps to attach the skateboard to. This was too bulky for the skateboard riders who wish to move fast free and easy (without heavy items on their backs or person's) on their skateboards. There have been other attempts to address this increasing need such as, U.S. Pat. No. 5,092,506 to Bolduc Mar. 3, 1992. This device is constructed and worn as you would a backpack, it has additionally two barrow type chambers for the wearer's back that you would purchase separately also costly and very bulky. Accordingly there are others [prior art] that have constructed skateboard carriers in the same form as the backpack harness type, U.S. Pat. No. 5,016,794 to Beagle Jr. May 21, 1991. This carrier device attaches to your back with two shoulder straps and one waist strap, it has a frame that lies across the back of one's shoulders and lower back, the two are held in place by a vertical member which runs the length of the wearer's back. This carrier is clearly another unsuitable balky and cumbersome device that does not answer the call for a lightweight efficiently functional quick and easy, skateboard carrier.

For many years there has been other attempts by inventors of the prior art to construct an efficient unobtrusive skateboard carrier. There were attempts by inventors to transform their snowboard carrier into a skateboard carrier U.S. Pat. No. 5,492,254 to Challoner et al. Feb. 20, 1996. This device has an upper member and a lower member that requires you to fit the carrier onto your board in a manner reminiscent of placing a hat and booties on a baby. There is a cap for the top section of the board and a pouch pocket for the lower section and two straps to fasten around the width of the midsection of the board. There are many maneuvers to this device and one must fold the carrier up and insert it into its own fanny pack or back pack type of secondary carrier. This is clearly unsuitable for the skateboarders of today who again, wish to move fast easy and free. Additionally there are carriers that can best be described as back and chests pressure straps, U.S. Pat. No. 6,536,639 to Frank Mar. 25, 2003. This device is an elastic strap with two elastic band type members that are fasten around the board's wheels and truck and is positioned across your back.

The board is held in place by the tension of the three elastic straps, clearly creating pressure against both the chest and back of the wearer with the high tension of the elastic. There is no adjustment of straps for looseness. Clearly this device will lose its elasticity and or snap over a short period of time. There are other carriers of this across one's chest and back type. There is the "Strap It 360" US patent number unknown, DK Enterprises LLC. This device is made of a coarse strap member that lays across the chest with two large elastic bands divided for the upper left and upper right wheels and the lower left and lower right wheels of the board. These elastic members are fragile, lasting durability and strength is highly unlikely. There is also a carrier device bearing the name SLINGZ, hands free Action Sports Strap, US patent number unknown, manufactured by the same name. This is an adolescent type of carrier having a 6 to 7 inch width ribbon type member across the wearer's chest and additionally, two connecting bands at each end of said member. It's unsuitable for the mature board pushers of today.

As an inventor of this present art (I too ride a long skateboard simply called, a long-board) I have watched and studied the skateboarders of today. To this inventor of the present art it is quite clear and I am completely certain that the skateboarders of today are still in need of an efficient lightweight, unobtrusive bulk free, multi-functional inexpensive skateboard carrier, which my [Present Invention] is. Furthermore it is without a doubt to this inventor there is a need for this present invention which is a better more efficient and practical skateboard carrier. Again the cited prior art have attempted to address the needs of the skateboarders of today but, have failed in one way or the other. Either their carrier is too bulky or too time consuming to maneuver the skateboard onto. Nor could they answer the question, where do I put the skateboard carrier when I'm not using it to carry my board? Yes there are carriers of all types and shapes out there today. There are even some carriers which hang across the back in a manner slightly similar to this present art skateboard carrier. Some carriers are expensive to manufacture Challoner U.S. Pat. No. 5,492,254-Bolduc U.S. Pat. No. 5,092,506. Other prior art are inadequate in durability-Strap it 360.

There are those with complex maneuvers Johnson U.S. Pat. No. 5,746,361. Most of the above mentioned carriers cannot rid themselves of their bulk, and are therefore totally undesirable for today's fast and free flowing skateboarders. Finally the above mentioned prior art carriers are not multi-functional nor are they designed like a stylish belt to wear around one's waist, when not using the carrier to carry your skateboard. This [Present Invention] skateboard carrier is without question definitely a today's kind of skateboarder's style carrier. The prior art mentioned are all confined to just one function that of, a carrier. There has been no skateboard carrier that could answerer all the needs of today's fast and free easy-flowing skateboarders, until now with my [Present Invention] Skateboard Carrier. For today's true skateboarders, it is a badge of honor to carry one's skateboard. It is for this reason that the true board pushers of today would not be caught seen with the un-cool, balky, obtrusive, time consuming, or adolescent type carriers of the mentioned prior art.

The skateboarders of today's society are a band of brothers, (females included) from city to city, state to state, and country to country; theirs is a world unto themselves. To enter the world of the board pushers of today you must be one of them, or truly know of them, their likes and dislikes, what they accept and what they will reject. This is why the above mentioned prior art have failed. Again they are out of touch and outdated. I believe this is why 70% of the true board pushers of today still choose to carry their skateboards. My present invention is truly a today's kind of skateboarder's carrier for the skateboarders of today. For the skateboarders and those who have attempted to answer the call of a lightweight easy to use, multi-functional skateboard carrier, it has remained elusive until now; it is my [Present Invention] skateboard carrier that has answered that call! To this inventor's knowledge there has never been a skateboard carrier designed like this. Further to my knowledge nor is there any skateboard carrier on the market today that can achieve the multi-functional capabilities of my, present invention.

BACKGROUND OF INVENTION

Objects and Advantages

I believe that the objects and advantages of my present invention will be made clear and distinguish it as a better skateboard carrier from the prior art mentioned carriers. The carriers mentioned in the [prior art] vary from outdated, too bulky, to out of touch. There is no question in this inventor's mind and further it is with absolute certainty that there remains a need for an unobtrusive multi-functional, lightweight cool, and stylish, skateboard carrier for today's board pushers which this present invention [present art,] is. This skateboard carrier with reflective stripe is a cool style, lightweight, multi-functional, easy to use skateboard carrier. It functions as a skateboard carrier strap and, it can be worn like a cool fashionable belt, when not being used to carry one's skateboard. It's inexpensive to make and can be made in an array of strap colors, textures and buckle styles, design combination possibilities are endless. It is a skateboard carrier strap with a cool reflective stripe that contours both sides of the complete length of the skateboard carrier strap. This skateboard carrier strap also has a cool expandable personal items pouch attached to it, for carrying small personal items, such as a music device, like an iPod, sunglasses, keys wallet, cell phone, etc.

This skateboard carrier strap with reflective stripe [Present art] is designed with alternate design type of inner laid, grip tape, loop band straps that makes it possible to carry any size skateboard, long board, deck board or any other size or type of skateboard. It's a totally hands and bulk free skateboard carrier when you're not using it to carry your skateboard. With its carrier strap design in an extension strap form one may choose to ride their skateboard, in a rodeo style manner. This skateboard carrier with its multi-functional extension strap design allows the user to attach its [Present art] skateboard carrier loop band straps to the underside of their skateboard around its wheels and truck. Now in this form it has been converted into an extension strap, and the rider can now ride their board holding the extended strap handle firmly in their hand and ride rodeo style. This means in this extended strap manner a skateboarder can now ride his board like a rodeo cowboy who stands up on the back of his rodeo horse holding the rains. This skateboard carrier with its unique extended strap design capability, one may also choose to use it as a safe strap. In the course of riding one's skateboard they may encounter on the streets, or in the skate parks, a piece of glass, pebbles, or twigs.

When the wheels of a skateboard hit any of these small items the board can be stopped short, the rider goes flying in one direction the skateboard in the other direction. Now if the rider is holding on to the carrier strap handle in its extension strap style it can help keep the rider in control of his skateboard, preventing the skateboard from jetting out into traffic or into a pedestrian. This skateboard carrier when in its unique extended strap design and when attached to the skateboard and strap handle held firmly in hand, allows the rider to stay in control of their skateboard. I believe further objects and advantages of this present invention will show conclusively through its descriptions and drawings it's many advantages, functionalities, and superiority over the prior art.

SUMMARY

This is a Skateboard Carrier Strap with a reflective Stripe. It has been designed and methodically thought through to be an unobtrusive lightweight, multi-functional stylish looking belt type skateboard carrier. It has been design to be unobtrusive when not being used to carry your skateboard.

It's a multi-functional, hands free and very cool skateboard carrier for today's cool hipster board pushers. Other functions of this present invention are its reflective stripe that is adhered to both sides of the entire length of the skateboard carrier body-strap. The skateboard carrier's loop and band straps also bear the same reflective stripe. This present invention skateboard carrier has been specifically designed in its unobtrusive, lightweight, easy to wear and cool belt style to be attractively appealing to the skateboarders of today. It is in this inventor's opinion simply the best and coolest designed, Skateboard Carrier ever, for the board pushers of today.

DETAILED DESCRIPTION OF THE PREFERRED EMBODIMENT

A preferred embodiment of the Skateboard Carrier with Reflective Stripe [carrier body-strap 10] of the present invention, (described here with method of making) is illustrated in [FIG. 1] (Front view belt style illustration). The carrier body-strap 10 with reflective stripe 20 can be made of but not limited to, polyester, nylon, or any other types of durable wedding strap material. The carrier body-strap 10 with reflective stripe 20 can range in size but not limited to, from half [½] an inch to a full two [2] inches in width. The skateboard carrier body-strap 10 with reflective stripe 20 has an overall but not limited to, lengths of 62 to 65 inches preferably. The carrier body-strap 10 has a reflective stripe 20 that contours the complete length on both sides of carrier body-strap 10.

The reflective stripe 20 that contours the complete length on both sides of carrier body strap 10 can range but not limited to, in sizes of ⅜ to ⅝ in width preferably and is available from a company like 3M or any other reflective and adhesive tape manufacturer. The reflective stripe 20 that contours the complete length of carrier body-strap 10 wedding is applied by means of heat transfer application. The reflective stripe 20 that contours the complete length on both sides of carrier body strap 10 heat transferring process can be done by a knowledgeable webbing manufacture or there of like. The carrier body-strap 10 with reflective stripe 20 which contours the complete length on both sides of carrier body strap 10 has two loop straps 12 attached to carrier body-strap 10 with reflective stripe 20 which contours the complete length on both sides of carrier body strap 10. The two loop straps 12 attached to carrier body-strap 10 with reflective stripe 20 that contours the complete length on both sides of carrier body strap 10, can be made but not limited to, a polyester, nylon or any other webbing material.

DETAILED DESCRIPTION OF THE PREFERRED EMBODIMENT

The two loop straps 12 attached to the carrier body-strap 10 with reflective stripe 20 which contours the complete length on both sides of carrier body strap 10 can range in but not limited to, widths of half [½] an inch preferably to a full two [2] inches. The two loop straps 12 attached to carrier body strap 10 with reflective stripe 20 which contours the complete length on both sides of carrier body strap 10, has an overall length but not limited to, 20 to 22 inches preferably. The two loop straps 12 attached to carrier body-strap 10 with reflective stripe 20 which contours the complete length on both sides of carrier body strap 10, also has reflective stripe 20 that overlays the length of the two loop straps 12 outer surface. The two loop straps 12 with its overlay reflective stripe 20, attached to carrier body-strap 10 with reflective stripe 20, which contours the complete length on both sides of carrier body strap 10, has a small expansion tab 28 attached to one of the two loop straps 12.

The small expansion tab 28, attached to one of the two loop straps 12, with its overlay reflective stripe 20, attached to carrier body-strap 10 with reflective stripe 20, which contours the complete length on both sides of carrier body strap 10, can be of but not limited to, a durable type of webbing material. The small expansion tab 28, attached to one of the two loop straps 12, with its overlay reflective stripe 20, attached to carrier body strap 10 with reflective stripe 20, which contours the complete length on both sides of carrier body strap 10, can be but not limited to, widths of ⅜ preferably or wider. The small expansion tab 28, attached to one of the two loop straps 12 with overlay reflective stripe 20 attached to carrier body strap 10 with its reflective stripe 20 which contours the complete length on both sides of carrier body strap 10, is but not limited to approximately 4½ inches in length, and is used to accommodate (in its belt form) larger waist size by expanding carrier body strap 10. The skateboard carrier body-strap 10 with reflective stripe 20, which contours the complete length on both sides of carrier body strap 10 and two loop straps 12, attached to carrier body strap 10 with its overlay reflective stripe 20 and small expansion tab 28 attached to one of the two loop straps 12, has an interlocking reflective buckle 14 [reflective buckle 14] attached to carrier body strap 10. The interlocking reflective buckle 14, attached to the carrier body-strap 10 with reflective stripe 20 which contours the complete length on both
sides of carrier body strap 10 and two loop straps 12 attached to carrier body strap 10 with its overlay reflective stripe 20, small expansion tab 28 attached to one of two loop straps 12, has a header half 14*a* and a receiving half 14*b*. The reflective buckle 14 attached to the carrier body-strap 10 with reflective stripe 20 which contours the complete length on both sides of carrier body strap 10, and two loop straps 12 attached to carrier body strap 10, with its overlay reflective stripe 20, small expansion tab 28 attached to one of two loop straps 12, has a reflective square 26 on the face of the reflective buckle's 14 receiving half 14*b*. The carrier body-strap 10 with reflective stripe 20 which contours the complete length on both sides of carrier body strap 10 and two loop straps 12 attached to carrier body strap 10 with its overlay reflective stripe 20, small expansion tab 28 attached to one of the two loop straps 12, with reflective buckle 14 having a header half 14*a* and a receiving half 14*b* with reflective square 26 on the face of reflective buckle's 14 receiving half 14*b*, has a single strap handle 16 attached at the opposite end of carrier body-strap 10.

The carrier body-strap 10 with reflective stripe 20 which contours the complete length on both sides of carrier body strap 10, and two loop straps 12 attached to carrier body strap 10 with its overlay reflective stripe 20, small expansion tab 28 attached to one of two loop straps 12, and interlocking reflective buckle 14 having a header half 14*a* and a receiving half 14*b* with reflective square 26 on the face of reflective buckle's 14 receiving half 14*b*, having a single strap handle 16 attached at the opposite end of carrier body strap 10, additionally has attached to it, a personal items pouch 18 (not claimed). The personal items pouch 18 attached to the carrier body-strap 10 with reflective stripe 20 which contours the complete length on both sides of the carrier body strap 10 and two loop straps 12, attached to carrier body strap 10 with its overlay reflective stripe 20, small expansion tab 28 attached to one of the two loop straps 12, reflective buckle 14, having a header half 14*a* and a receiving half 14*b* with reflective square 26 on the face of the reflective buckle's 14 receiving half 14*b*, having a single strap handle 16 attached at the opposite end of carrier body strap 10, is approximately but not limited to 6 to 7 inches in length. The personal items pouch 18, which is, attached to the carrier body strap 10, with reflective stripe 20 which contours the complete length on both sides of the carrier
body strap 10, with two loop straps 12 attached to carrier body strap 10 with its overlay
reflective stripe 20, small expansion tab 28 attached to one of the two loop straps 12, reflective buckle 14 having a header half 14*a* and a receiving half 14*b* with reflective square 26 on the face of reflective buckle's 14 receiving half 14*b*, having a single strap handle 16 attached at the opposite end of carrier body strap 10, is made of but not limited to a flexible durable giving and retractable type of material. Accordingly the personal items pouch 18 is attached to the carrier body strap 10 with reflective stripe 20 which contours the complete length on both sides of the carrier body strap 10, two loop straps attached to carrier body strap 10 with overlay reflective stripe 20, small expansion tab 28 attached to one of the two loop straps 12, a reflective buckle 14, having a header half 14*a* and a receiving half 14*b* with reflective square 26 on the face of reflective buckle 14 receiving half 14*b*, strap handle 16 attached at the opposite end of carrier body strap 10, by means of a top and (not visible) bottom elastic tab 36.

The two elastic tabs 36 which is attached to personal items pouch 18, which is attached to the carrier body strap 10 with reflective stripe 20 which contours the complete length on both sides of carrier body strap 10 with two loop straps 12 attached to carrier body strap 10 with its overlay reflective stripe 20, small expansion tab 28 attached to one of the two loop straps 12, a reflective Buckle 14 having a header half 14*a* and a receiving half 14*b* with reflective square 26 on the face of reflective buckle 14 receiving half 14*b*, strap handle 16, attached at the opposite end of carrier body strap 10, allows for a degree of mobility and flexibility of the personal items pouch 18. The carrier body strap 10 with reflective stripe 20 which contours the complete length on both sides of the carrier body strap 10 with two loop straps 12 attached to carrier body strap 10 with overlay reflective stripe 20, small expansion tab 28 attached to one of the two loop straps 12, a reflective Buckle 14 having a header half 14*a* and a receiving half 14*b* with reflective square 26 on the face reflective Buckle 14 receiving half 14*b*, strap handle 16 attached at the opposite end of carrier body strap 10, personal items pouch 18, attached by means of two elastic tabs 36 on the carrier body strap 10, will has a VELCRO (hook &loop) receiving miniature emblem patch (not shown) attached and located beneath the personal items pouch 18.

DETAILED DESCRIPTION OF THE PREFERRED EMBODIMENT

Figure 2:
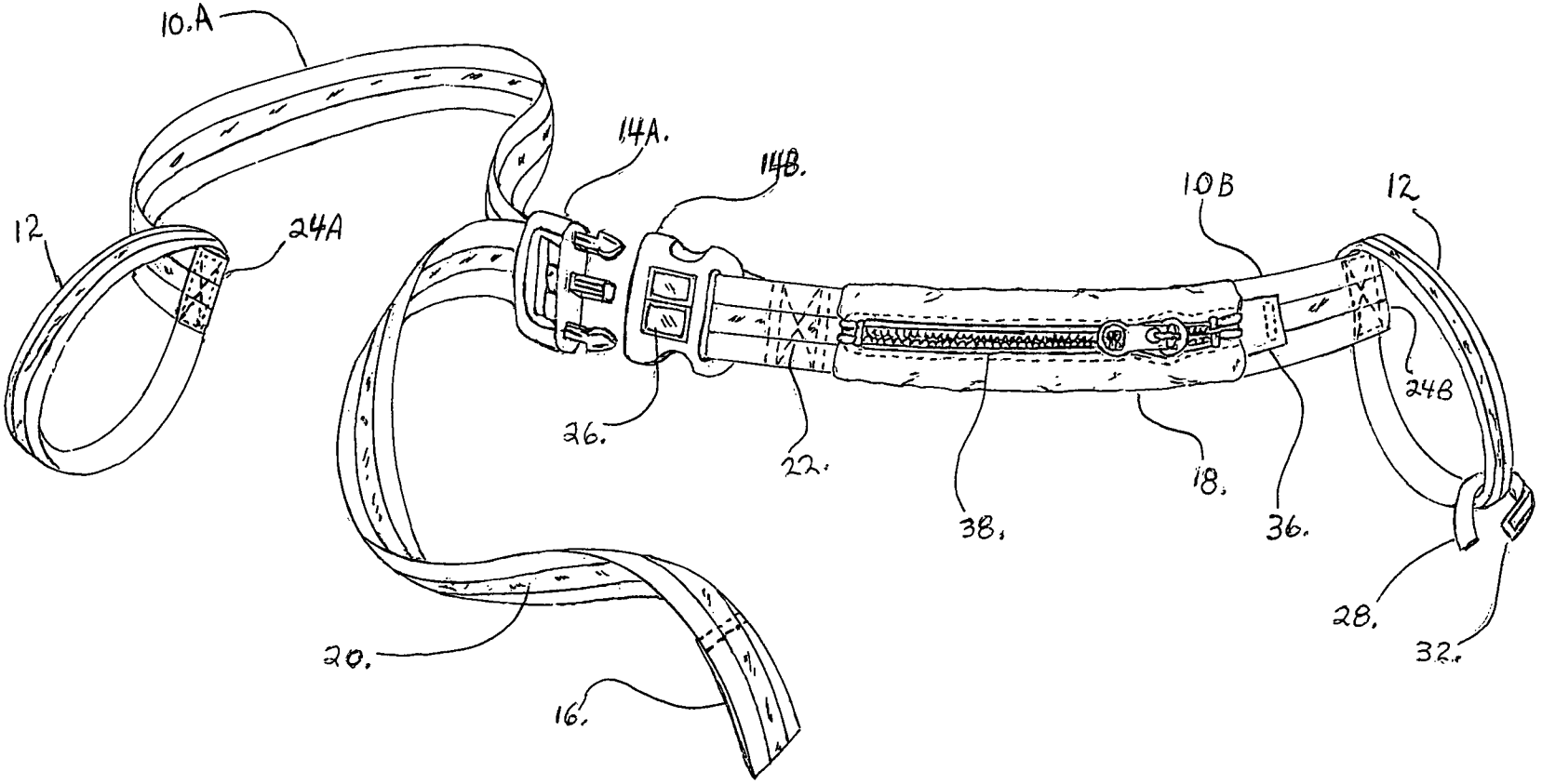

A preferred embodiment of the present art, Skateboard Carrier Body Strap with Reflective Stripe [carrier body-strap 10] of the present invention is now illustrated in [FIG. 2] Frontal view of, skateboard carrier body-strap 10 in a separated state, having a lower carrier body strap 10*a* and an upper carrier body strap 10*b* with reflective stripe 20, which contours the complete length on both sides of carrier body strap 10 and two loop straps 12, attached at one end of each of the lower carrier body strap 10*a* and upper carrier body strap 10*b*, attached to carrier body strap 10 with its overlay reflective stripe 20, small expansion tab 28 attached to upper loop strap 12*b* of the two loop straps 12, reflective buckle 14 having a header half 14*a* and a receiving half 14*b* with reflective square 26 on the face of reflective buckle's 14 receiving half 14*b*, a single strap handle 16 attached at the opposite end of lower carrier body strap 10*a*, with personal items pouch 18 attached to upper carrier body strap 10*b* by means of two elastic tabs 36, additionally having a VELCRO (hook&loop) receiving miniature emblem patch (not shown) attached and located beneath the personal items pouch 18.

The carrier body-strap 10 with VELCRO (hook&loop) fastener square patches 24 [FIG. 1] now in a separated state [FIG. 2] now showing Velcro fastener square patch 24*a* in a separated state and located at one end of lower carrier body strap 10*a* in a separated state from opposing, VELCRO (hook&loop) fastener Square patch 24*b* located at one end of upper carrier body strap 10*b*. Accordingly reflective buckle 14 disengaged in a separated state, of two half's having reflective buckle's 14 header half 14*a* disengage and separated from reflective buckle's 14 receiving half 14*b*. Now having the above mentioned, represented here in a separated state. Accordingly with regards to carrier body-strap 10 in its separated state with reflective stripe 20, which contours the complete length on both sides of carrier body strap 10 and two loop straps 12 attached at each end of said separated carrier body strap 10 with its overlay reflective stripe 20, small expansion tab 28 attached to upper loop strap 12*b* of the two loop straps 12, reflective buckle 14 having a header half 14*a* and a receiving half 14*b* with reflective square 26, on the face of reflective buckle's 14 receiving half 14*b*, a single strap handle 16 attached at the opposite end of carrier body strap 10*a* also having a personal items pouch 18 attached by means of two elastic tabs 36 on the upper carrier body strap 10*b*.

Now with respect to [FIG. 2] carrier body strap 10 in a separated state by means of separating the VELCRO (hook&loop) fastener Square patches 24*a* attached and located at one end of the lower carrier body-strap 10*a*, separated from VELCRO (hook&loop) fastener Square patch 24*b* attached and located at one end of its upper carrier body strap 10*b*. Accordingly carrier body strap 10 in said separated state of having a lower carrier body-strap 10*a* member, and an upper carrier body strap 10*b* member. Accordingly now having carrier body strap 10 all in a separated state of two half's. The carrier body straps 10 being in this separated state of two members having an upper carrier body strap 10*b* and a lower carrier body strap 10*a*. Carrier body strap 10 is now in a manner, by which it is ready to receive a skateboard (not shown). The means by which to attach and effectuate this present invention skateboard carrier body-strap 10 to a skateboard. In this it's separated state having an upper carrier body-strap member 10*b*, and a lower carrier body-strap member 10*a*, will be explained comprehensively and in depth, henceforth.

Figure 3:
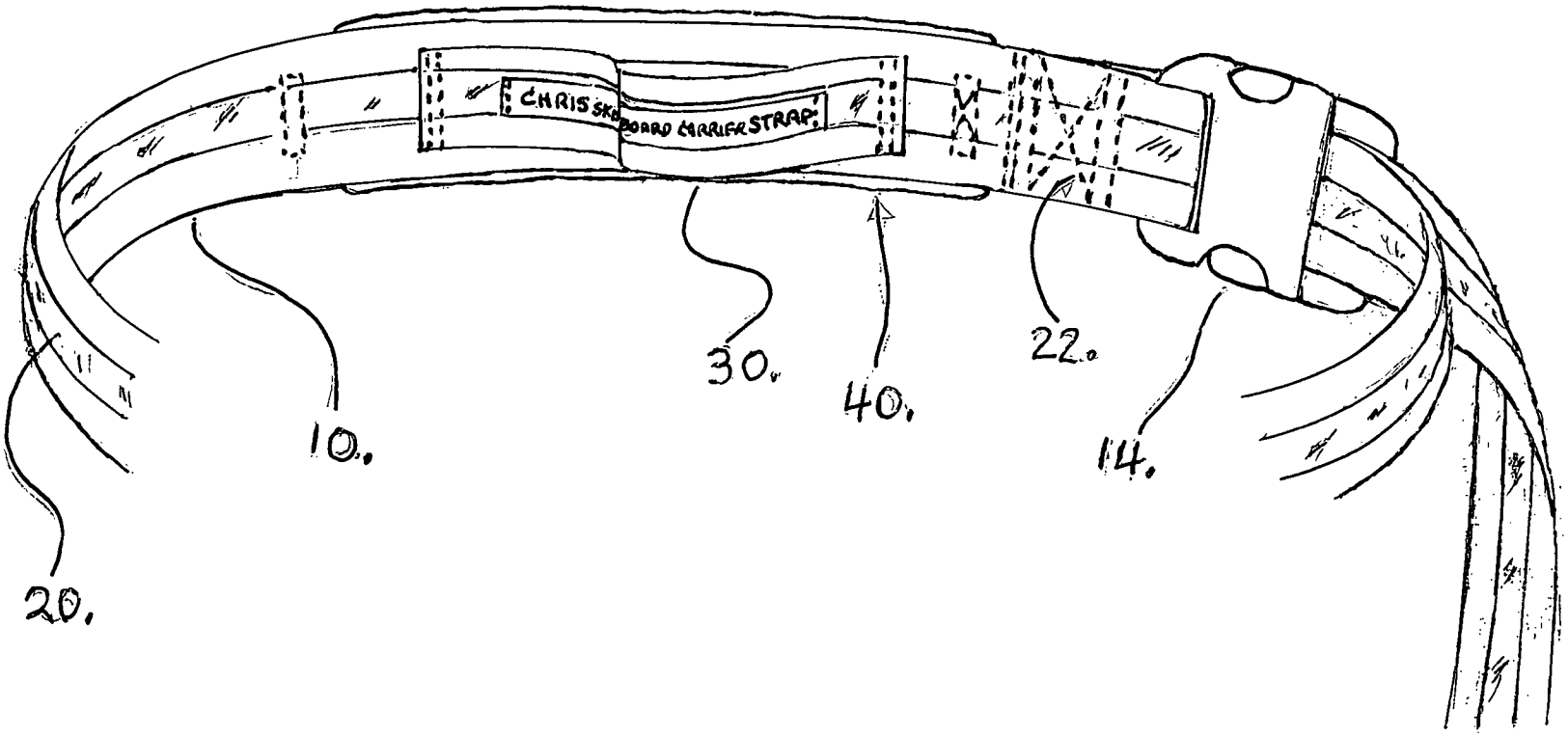

Now with respect to [FIG. 3] a preferred embodiment of the present invention, Skateboard Carrier Strap with Reflector Stripe [carrier body-strap 10] is now illustrated; [FIG. 3] Here in shown is a back viewing, of the skateboard carrier body-strap 10 with reflective stripe 20 which contours the complete length on both sides of the carrier body strap 10. Also visible of this back viewing is reflective buckle 14 engaged and, Secure Swing Strap 30 attached to the inner side of the (when in its separated state) upper carrier body strap 10*b*. Said secure swing strap 30 [FIG. 3] attached to the inner side of upper carrier body strap 10*b* with reflective stripe 20 which contours the complete length on both sides of carrier body strap 10 and reflective buckle 14 engage, can be but not limited to, of any durable polyester, nylon, or there of webbing. Said secure swing strap 30 attached to the inner side of upper carrier body-strap 10*b* may be in but not limited to widths of one [1] to two [2] inches preferably.

Additional Embodiment

Figure 4:
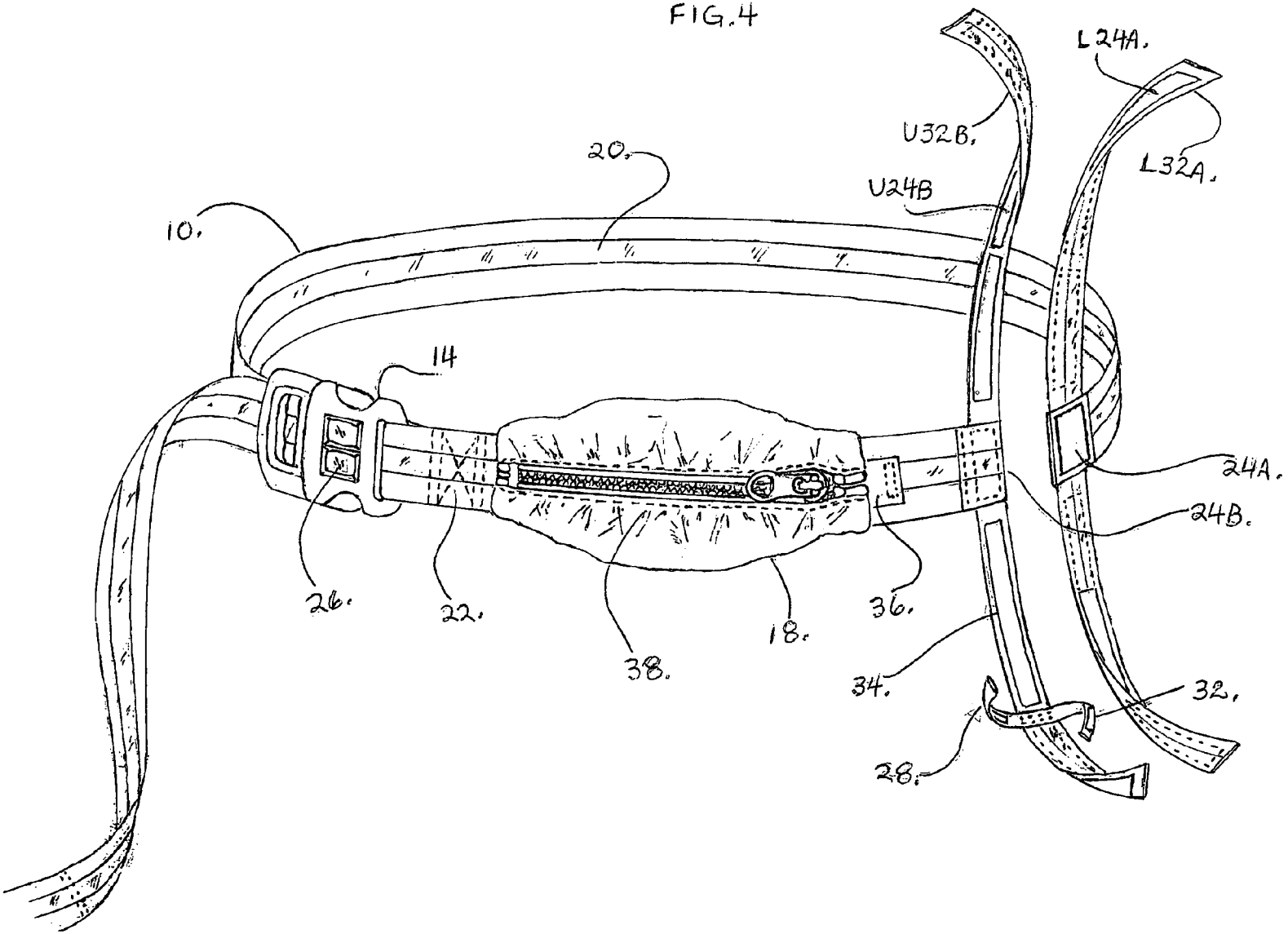

Additional embodiment now shows [FIG. 4] Skateboard Carrier with Reflective Stripe [carrier body strap 10] with alternative VELCRO (hook&loop) Fastener open loop Straps 32 with reflective stripe 20 which contours the complete length of the carrier body strap 10, a reflective buckle 14 having a header half 14*a*, and a receiving half 14*b*, with reflective square 26 on the face of reflective buckle's 14 receiving half 14*b*, having a single strap handle 16 attached at opposite end of carrier body strap 10, with personal items pouch 18 attached by means of two elastic tabs 36, attached to the carrier body strap 10, VELCRO (hook&loop) miniature emblem patch will be attached and located beneath the personal items pouch 18, and additionally having two alternative VELCRO (hook&loop) fastener open loop straps 32 with inner laid grip tape 34, of the present invention, Skateboard Carrier Strap with Reflective Stripe [carrier body-strap 10]. Now with respect to [FIG. 4] carrier body-strap 10 with reflective strip 20, which contours the complete length on both sides of the carrier body strap 10, with alternative VELCRO (hook&loop) fastener open loop straps 32 attached at each end of lower carrier body strap 10*a* and upper carrier body strap 10*b* with its overlay reflective stripe 20, reflective buckle 14 having a header half 14*a* and a receiving half 14*b* with reflective square 26 on face of the reflective buckle's 14 receiving half 14*b*, having a single strap handle 16 attached at opposite side of carrier body strap 10, a personal items pouch 18, attached by means of two elastic tabs 36 on the carrier body strap 10, VELCRO (hook&loop) miniature emblem patch will be attached and located beneath the personal items pouch 18. The VELCRO (hook&loop) fastener open loop straps 32 attached to the carrier body strap 10 can be of but not limited to, any type of polyester, nylon or any other durable webbing. The VELCRO (hook&loop) fastener open loop straps 32 attached to the carrier body-strap 10 can range but not limited to, in widths of 1 inch to 2 inches, preferably. Now with respect to the VELCRO (hook&loop) fastener open loop straps 32 inner laid grip tape 34. The inner grip tape 34 attached to the Velcro fastener open loop straps 32, attached to the carrier body strap 10 with reflective stripe 20 which contours the complete length on both sides of the carrier body strap 10 with alternative VELCRO (hook&loop) fastener open loop straps 32, attached at each end of carrier body strap 10, expansion tab 34 attached to one of the two VELCRO (hook&loop) fastener open loop straps 32, with its overlay reflective stripe 20, a reflective buckle 14 having a header half 14*a* and a receiving half 14*b* with reflective square 26 on the face of reflective buckle's 14 receiving half 14*b*, having a single strap handle 16 attached at opposite end of carrier body strap 10, personal items pouch 18 attached by means of two elastic tabs 36 on carrier body strap 10, well have a VELCRO (hook&loop) miniature emblem patch attached and located beneath personal items pouch 18. Additionally having VELCRO (hook&loop) fastener strips U 24*a*, and L24*a*, located on both ends, of the inner sides of both the VELCRO (hook&loop) fasteners open loop straps 32. The grip tape 34 on both sides of the inner side of both Velcro fastener open loop straps 32 is made of a high friction adhesive and, the like. The VELCRO (hook&loop) fastener open loop straps 32, with inner grip tape 34, located at both ends of carrier body-strap 10, accordingly carrier body strap 10 is separated [FIG. 2] by means of . . . .

Preferred Embodiment Operation

Method of appropriating, and actuating carrier body strap 10 FIGS. 2&3 Illustrated. Carrier body strap 10 in a separated state of having two members, lower carrier body strap 10*a* and upper carrier body strap 10*b* . . . separating VELCRO (hook&loop) square patch 24*a* from its receiving VELCRO (hook&loop) square patch 24*b* also located at each end of carrier body-strap 10. In its separated state by means of separating VELCRO (hook&loop) square patch 24*b* from its receiving VELCRO (hook&loop) square patch 24*a* located at each end of carrier body-strap 10. Now with respect to the carrier body-strap 10, reflective buckle 14, in a disengaged separated state, having its receiving half 14*b* separated from its header half 14*a*. Now with respect to [FIG. 2] the reflective buckle 14 in its two halfs disengaged and separated state, having a receiving half 14*b* and header half 14*a* and, carrier body strap 10 separated, by means of VELCRO (hook&loop) fastener square patch 24*b* separated and detached from its receiving VELCRO (hook&loop) fastener square patch 24*a*. Now with respect to all above-mentioned in said separated state, upper carrier body strap's 10*b*, loop strap 12*b*, is ready to be looped around a skateboard's (not shown) upper wheels and truck.

Now with respect to [FIG. 2] lower carrier body strap's 10*a* loop strap 12*a*, it is thereby also in a manner to be looped around the skateboard's lower truck and wheels. Now with respect to [FIG. 2] in the above mentioned state, upper carrier body strap 10*b* loop strap 12*b* looped around wheels and truck of a skateboard (not shown) and lower carrier body strap 10*a* loop strap 12*a* looped around lower said skateboard's (not shown) wheels and truck. Now in this form the user, of this preferred embodiment skateboard carrier body strap 10 present art, will grasp secure swing strap 30 [FIG. 3] with fourth and middle finger in a manner to securely bring about and position skateboard (not shown) across one's back. At said stage the user well bring about and, position with skateboard attached (not shown) the upper body strap 10*b* over the shoulder. Now with respect to lower carrier body strap 10*a* attached to skateboard's (not shown) lower wheels and truck.

The user of this preferred embodiment, will now bring the lower carrier body strap 10*a* under the opposite arm of the upper carrier body strap 10*b* shoulder and engage reflective buckle's 14 receiving half 14*b* with header half 14*a*. Once reflective buckle's 14 header half 14*a* and receiving half 14*b* are engaged, the user of this present art will have skateboard firmly secured across back and pull strap handle 16 for desired tension.

Additional Embodiment

Operation

Now with respect to the drawings, specifically FIGS. 1,2&4 illustrated shows skateboard carrier body strap 10 additional with alternate Velcro fastener band loop straps 32 with inner laid grip tape 34. The means by which to appropriate and actuate this skateboard carrier body strap 10 with alternate VELCRO (hook&loop) fastener band loop straps 32 to a long-board (not shown) here in described. Now with respect to FIG. 4 means by which to detach, disengage, and separate reflective buckle 14 having a header half 14*a* and a receiving half 14*b* with reflective square 26 on face of reflective buckle 14 receiving half 14*b*. With reflective buckle 14 disengage receiving half 14*b* from its header half 14*a*. Now with respect to VELCRO (hook&loop) square patch 24, detach and separate Velcro square patch 24*a* from and it's receiving VELCRO (hook&loop) square patch 24*b*. Now with respect to FIG. 4 in a separated state of two half's members, having an upper carrier body strap 10*a* member and a lower carrier body strap 10*b* member in a state identical to that of FIG. 2 alternatively having VELCRO (hook&loop) fastener band loop straps 32 attached at each end of lower carrier body strap 10*a* member and upper carrier body strap 10*b* member.

Now with respect to the upper carrier body strap 10*b* with reflective buckle 14's receiving half 14*b*, located at one end of upper carrier body strap 10*b* with personal items pouch 18 attached to carrier body strap 10*b* by means of two elastic tabs 36 additionally having one of the two VELCRO (hook&loop) fastener band loop straps 32*b* located at said end of carrier body strap 10*b*. Now with respect to Velcro fastener band loop strap 32*b* attached at one end of the carrier body strap 10*b*. Position upper carrier body strap 10*b*'s Velcro fastener band loop strap 32*b* around the width of the long-board's midsection, secure and fasten VELCRO (hook&loop) open loop strap 32*b*'s Velcro strip 24*d*. Now with respect to lower carrier body strap 10*a*, with reflective buckle 14's header half 14*a*. Having a single strap handle 16 located at opposite end of upper carrier body strap 10*a*, alternatively having VELCRO (hook&loop) fastener loop strap 32*a* attached at said end of upper carrier body strap 10*a*.

CONCLUSION, RAMIFICATIONS AND SCOPE

It is the belief of this inventor that, any one reading and or examining the present art. Its objects and advantages, drawings and, detailed description, would undoubtedly conclude that this present art is a better skateboard carrier, then the mentioned and sited prior art. This present art skateboard carrier with reflective stripe is a multi-functional, unobtrusive lightweight, easy to use, reflective stripe bearing, cool and fashionable belt style, lest we forget we are talking about a skateboard carrier. A skateboard carrier that the skateboarder's of today will appreciate for its multi-functional capabilities, its endless combination of strap colors textures and buckle design possibilities. Every so often there comes along one device, one invention, one product, that answers the needs of a consumer group. My present art skateboard carrier with its reflective stripe, cool belt style, making it unobtrusive, multi-functional and inexpensive to make is that device, is that present skateboard carrier, for that consumer group, the skateboarders of today.

The advantages of this present art skateboard carrier are many; this skateboard carrier strap with its multi-functional extended strap design allows the user to attach this skateboard carrier to the underside of one's skateboard and if so desired use this carrier strap as a safe strap and or rodeo ride style. To the reader let it be remembered that the scope of this Skateboard Carrier with Reflective Stripe is not limited by its drawings, its material detailed description or method of making. There are a variety of fasteners and belt buckles style combinations and even more style and design material combinations and other functionalities that can be derived from the limited detailed suggested method here in disclose, of the present art skateboard carrier style. Therefore let us not base this new and unique style skateboard carrier solely on the above mentioned descriptions. Rather, let it also be judge on the claims set forth here in with.

Additional Embodiment

Operation

Thus, all are appropriate and actuate by same means and method of above stated, upper carrier body strap 10*b*'s engagement. Now with respect to [FIG. 2] with alternate, VELCRO (hook&loop) fastener band loop straps, [FIG. 4] skateboard carrier strap 10 [FIG. 1] of the preferred embodiment, in a separated state and [FIG. 2] is ready for mounting.

DRAWINGS AND FIGURES

FIG. 1. Illustration, Shows Skateboard Carrier Strap with Reflective Stripe, Loop Straps with expansion tab. Personal Items Pouch, Reflective Face Buckle in a Waist Belt Form FIG. 2. Illustration, Shows Skateboard Carrier with Reflective Stripe. Loop Straps with expansion tab. Personal Items Pouch, skateboard carrier (in a separated state), having an upper and lower carrier body-strap member and Reflective Face Buckle disengage.

FIG. 3. Illustration, Shows back view of Skateboard Carrier Strap with Reflective Stripe. A Secure Swing Strap and back viewing of personal items pouch, with Reflective Face Buckle engaged.

FIG. 4. Illustration, Shows Skateboard Carrier Strap with Reflective Stripe. A Personal Items Pouch Expanded. Alternate VELCRO (hook&loop) Fastener open Loop Straps with Grip Tape.

DRAWINGS

Reference Numbers

10 Body strap
10*a* Upper carrier body strap
10*b* Lower carrier body strap
12 Loop straps
14 Reflective buckle
14*a* Reflective buckle header half
14*b* Reflective buckle receiving half
16 Strap handle
18 Personal items pouch
18*a* Personal items pouch (back)
20 Reflective stripe
22 Stitching
24 VELCRO (hook&loop) square patch
24*a* VELCRO (hook&loop) square patch
24*b* VELCRO (hook&loop) square patch
U24*a* VELCRO (hook&loop) strip
L24*a* VELCRO (hook&loop) strip
26 Reflective square
28 sm. Expansion tab
30 Secure swing strap
32 VELCRO (hook&loop) fastener open loop strap
L32*a* VELCRO (hook&loop) fasteners strap
U32*b* VELCRO (hook&loop) fasteners strap
34 Grip tape
36 Elastic tabs

The invention claimed is:

1. A carrier strap for recreational equipment, comprising:
an upper strap having a first end and a second end, comprising:
a first part of a first releasable mating fastener disposed on the first end of the upper strap;
a first part of a second releasable mating fastener disposed on the second end of the upper strap; and
a loop strap disposed on the second end of the upper strap proximate to the second releasable mating fastener, having an open and a closed position;
wherein the first releasable mating fastener is separate from the second releasable mating fastener; and
a lower strap having a third end and a fourth end, comprising:
a second part of the first releasable mating fastener, mating with the first part, and disposed on the third end of the lower strap;
a second part of the second releasable mating fastener, mating with the first part, and disposed on the fourth end of the lower strap; and
a second loop strap disposed on the fourth end of the lower strap proximate to the second releasable mating fastener, having an open and a closed position;
wherein the carrier strap has a first configuration;
the two parts of the first releasable mating fastener and the two parts of the second releasable mating fastener are mated and the carrier strap forms a closed loop; and
wherein the carrier strap has a carry configuration:
the two parts of the first releasable mating fastener are mated and the two parts of the second releasable mating fastener are detached, the loop strap and the second loop strap engage the recreational equipment, and the recreational equipment acts to create a loop-like configuration with the upper and the lower straps.

2. The carrier strap of claim 1, wherein:
the first releasable mating fastener is a buckle, and
the second releasable mating fastener is a hook and loop type fastener.

3. The carrier strap of claim 1, further comprising:
a reflective strip disposed on at least one of the upper and the lower straps.

4. The carrier strap of claim 1, further comprising:
a resealable carrying pouch disposed on at least one of the upper and the lower straps.

5. The carrier strap of claim 1, wherein at least one of the loop strap and the second loop strap further comprise a third releasable mating fastener to open and close the loop.

6. The carrier strap of claim 1, wherein at least one of the loop strap and the second loop strap further comprise high friction grip tape material to engage the recreational equipment.

7. The carrier strap of claim 1, wherein the recreational equipment is selected from the group consisting of a skateboard, a snowboard, a longboard, a deck board, roller blades, ice skates, baseball bats, hockey sticks, and golf umbrellas.

8. The carrier strap of claim 1, wherein at least one of the upper and the lower straps further comprise a length adjustment device to control the length of the straps.

9. The carrier strap of claim 1, wherein the carrier strap has a second configuration:

the two parts of the first releasable mating fastener and the two parts of the second releasable mating fastener are detached and the carrier strap forms a separate upper strap and a lower strap.

* * * * *